US006725639B2

(12) United States Patent
Ishii et al.

(10) Patent No.: US 6,725,639 B2
(45) Date of Patent: Apr. 27, 2004

(54) YARN TEXTURING DEVICE, YARN TEXTURING METHOD AND WINDING PACKAGE EMPLOYING QUALITY INDICATING FUNCTION

(75) Inventors: Kazuki Ishii, Uji (JP); Koichiro Oshiumi, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 106 days.

(21) Appl. No.: 10/003,267

(22) Filed: Dec. 6, 2001

(65) Prior Publication Data

US 2002/0092946 A1 Jul. 18, 2002

(30) Foreign Application Priority Data

Jan. 17, 2001 (JP) ..... 2001-008519

(51) Int. Cl.[7] ..... D01H 13/26; G01B 1/00

(52) U.S. Cl. ..... 57/264; 57/287; 57/334; 242/178

(58) Field of Search ..... 57/264, 265, 281, 57/284, 287, 288, 313, 332–349, 351; 242/178, 475.7, 476.7, 481.4, 485, 485.5; 28/248

(56) References Cited

U.S. PATENT DOCUMENTS

| | | | | |
|---|---|---|---|---|
| 4,720,702 A | | 1/1988 | Martens | |
| 5,660,343 A | * | 8/1997 | Schippers et al. | 242/172 |
| 6,405,966 B1 | * | 6/2002 | Lieber et al. | 242/478.2 |

FOREIGN PATENT DOCUMENTS

| | | | | |
|---|---|---|---|---|
| DE | 44 15 677 A1 | | 11/1994 | |
| EP | 0 406 736 A1 | | 1/1991 | |
| EP | 820951 A1 | * | 1/1998 | B65H/67/06 |
| EP | 0 876 985 A1 | | 11/1998 | |
| EP | 0 939 318 A1 | | 9/1999 | |
| JP | 10-77160 | | 3/1998 | |

* cited by examiner

*Primary Examiner*—Gary L. Welch
*Assistant Examiner*—Shaun R Hurley
(74) *Attorney, Agent, or Firm*—Westerman, Hattori, Daniels & Adrian, LLP

(57) ABSTRACT

The object of the present invention is to allow the reliable identification of the quality level of the winding package based on the yarn quality such as the yarn winding tension or the twisting density when manufacturing a winding package. According to the draw texturing machine for winding while traversing the false-twist textured yarn Y unwound from the supply yarn package and forming a winding package 7 of taper end form, a tension sensor 20 for detecting the tension of the yarn Y to be processed into a winding package 7, and a quality level judging means 30 for judging the quality level of the winding package 7 based on the detected tension information, are provided. Moreover, a winding controller 28 is provided with a winding terminating position setting means 28*b* for coordinating the quality level judging means 32 and the traverse device T so that the straight winding position (b1)~(b3) at the finishing of the winding process of the winding package 7 is to be determined in the differing axis direction based on the judged result of the quality level judging means 32.

6 Claims, 5 Drawing Sheets

YARN TEXTURING DEVICE, YARN TEXTURING METHOD AND WINDING PACKAGE EMPLOYING QUALITY INDICATING FUNCTION

FIELD OF THE INVENTION

The present invention relates to a yarn texturing device and a yarn texturing method comprising a yarn texturing unit for texturing a yarn, and a yarn winding unit for forming a winding package by winding the textured yarn, and especially to indication with a glance of the quality level of the textured yarn at the stage it is formed into a winding package.

BACKGROUND OF THE INVENTION

Conventionally, the yarn texturing device such as a draw texturing machine comprises per each spindle, a yarn texturing unit for applying designated texturing to the yarn, and a yarn winding unit including a traverse device for traversing the yarn in the axis direction of the winding package. Moreover, such yarn texturing device is constructed to form the winding package of the yarn applied with designated texturing.

Recently, to intensify the quality control of the winding package, the yarn texturing device is provided with a quality detecting means for detecting the quality of filament yarn or the like to be processed into the winding package, and a quality level judging means for judging the quality level of the winding package based on the detected information of the quality detecting means.

Since the quality of the yarn of the winding package to be formed in the yarn winding unit is known, an identifying seal indicating the quality is pasted automatically to the winding package which is to be discharged from the yarn winding unit of each spindle. The winding packages with the quality indicated were classified by the workers looking at the identifying seal or by the automatic identifying device for distinguishing the identifying seal.

However, since an exclusive process for pasting the identifying seal onto the winding package becomes necessary, there was still a further improvement left behind.

Moreover, the winding package discharged from the yarn winding unit of each spindle is required to be transported to the position to be pasted with an identifying seal. Therefore, in the case the worker removes the winding package during the transportation, the correspondence of the quality level data of the identifying seal and the winding package are displaced and the desired result cannot be achieved at all times.

The present invention was made in consideration to aforementioned problems, and it is thus the object of the present invention to allow the identification of the quality level of the wound yarn reliably when forming the winding package, and to allow the operation of the post-process to be appropriate and smooth, corresponding to the identification of the quality level.

SUMMARY OF THE INVENTION

The yarn texturing device of the present invention comprises a yarn texturing unit for texturing a yarn and a yarn winding unit for forming a winding package by winding a textured yarn. The yarn winding unit includes a traverse device for traversing the textured yarn in the axis direction of the bobbin. The traverse device is constructed so that a straight winding can be formed at a designated position in the axis direction of the winding package. Moreover, the yarn texturing device comprises a quality detecting means for detecting the quality of the yarn to be textured by the yarn texturing unit, a quality level judging means for judging the quality level of the winding package based on the detected information of the quality detecting means, and a winding terminating position setting means for changing the straight winding position by the traverse device at the finishing of the winding process based on the judged information of the quality level judging means.

According to aforementioned structure, (1) the quality level of the winding package is judged based on the detected information of the quality detecting means for detecting the quality of the yarn to be processed into a winding package, and based on such judged result, the winding terminating position of the winding package in the axis direction is determined. Therefore, for example, when it is the desired quality level, the winding terminating position is located at the center, and when it is below the desired quality level, the winding terminating position inclines to either ends of left or right, when it is other than the states of the formers, the winding terminating position inclines to the middle of the center and the either ends of left or right. As in such manner, the winding terminating position can be changed automatically according to the differences in the quality level.

In other words, according to the winding package to be formed by winding while traversing the yarn, (2) the quality level of the winding package completed of winding is indicated according to the winding terminating position. Therefore, the quality level of the winding package can be confirmed instantly just by a glance at the winding package, and the quality level indicating function by the winding terminating position is to be maintained reliably until the yarn is unwound. Accordingly, an exclusive process to attach a quality level mark or signal becomes unnecessary. As a result, the management cost for such purpose also becomes unnecessary, the quality level mark or signal is prevented from being attached in a mistake or being forgotten to be attached.

The yarn winding device according to the present invention comprises a yarn heating device and a false-twisting device for applying false-twisting texturing to the yarn unwound from a yarn supplying package, and a winding device for forming a winding package by winding the false-twist textured yarn. The winding device includes a traverse device for traversing the false-twist textured yarn in the axis direction of the bobbin. The traverse device is constructed so that a straight winding can be formed at a designated position in the axis direction of the winding package. The yarn winding device of the present invention comprises a quality detecting means for detecting the quality of the yarn to be wound to the winding package, a quality level judging means for judging the quality level of the winding package based on the detected information of the quality detecting means, and a winding terminating position setting means for changing the straight winding position by the traverse device at the finishing of the winding process based on the judged information of the quality level judging means.

According to the structure mentioned above, in the winding package formed via the yarn heating device and the false-twisting device for applying false-twist texturing to the yarn unwound from the yarn supplying package, and the yarn winding device, aforementioned effects (1) and (2) can be achieved.

According to the structure of the present invention, the quality detecting means is a tension detector for detecting the untwisting tension in the downstream side of the false-twisting device.

Moreover, the quality level of the winding package is judged by the condition of the untwisting tension in the downstream side of the false-twisting device. The untwisting tension is a factor for causing a significant effect to the false-twist texturing. Therefore, if the quality level can be determined by the untwisting tension, the main characteristics of the actual winding package can be shown straightforward, and a preferable quality level judgment conformed to the actual circumstance can be carried out.

In addition, the present invention is characterized in that a feed back control means is provided for carrying out a feed back control on the driving the false-twisting device so that the detected tension by the tension detector is to maintain the target value set in advance.

Since the feed back control is carried out so that the actual untwisting tension is to become the target tension value, not only the quality level indicating function for indicating the quality level of the winding package, but also the quality level concerning the winding package can be controlled to be the set state constantly. The quality level of the winding package formed beyond this control level is indicated clearly.

The method of the present invention is a yarn texturing method for applying texturing to the running yarn and forming a winding package by winding the textured yarn. The winding package is formed by winding while traversing the textured yarn in the axis direction of the winding package, and based on the detected result of the quality of the yarn to be wound to the winding package, the quality level of the winding package is judged. Moreover, according to the judged result, the straight winding position in the axis direction of the winding package is changed at the finishing of winding process, and the quality level of the yarn is made to be indicated at the straight winding position of the winding package.

According to such method, the winding terminating position of the winding package controlled as a straight winding of which is easily confirmed with a glance, and the confirmation of the winding terminating position, in other words, the quality level can be carried out easily while the effects 1 and 2 are achieved.

DETAILED DESCRIPTION OF THE PREFERRED EMBODIMENTS

A yarn texturing device constructed in a draw and false-twist texturing machine 1 according to an embodiment of the present invention will now be described in reference to the accompanying drawings.

Figure 1:
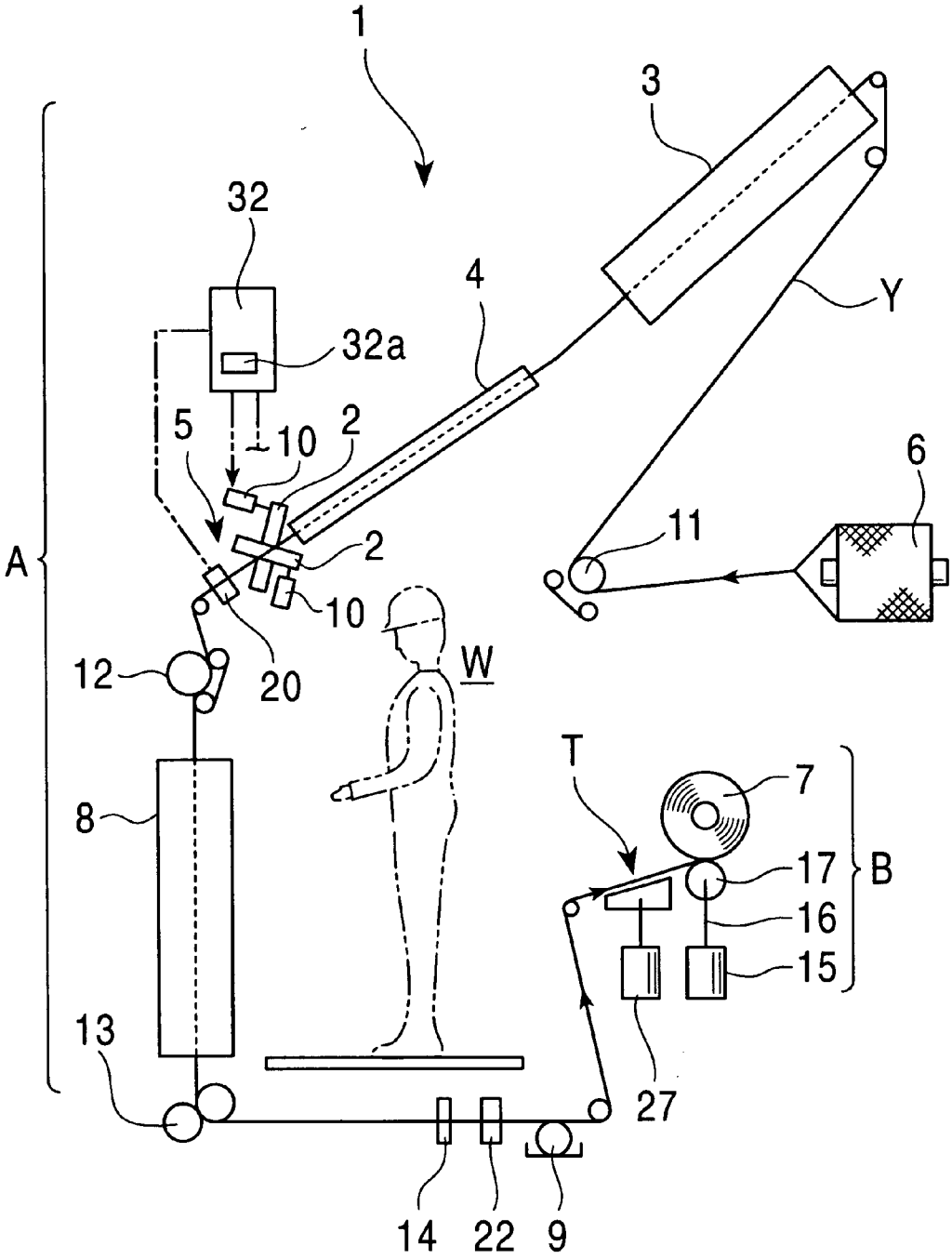
FIG. 1 is a schematic diagram showing the structure of the draw texturing machine as a yarn texturing device according to an embodiment of the present invention.

First, the outlined structure of the draw texturing machine 1 will be described. Referring to FIG. 1, the draw texturing machine 1 comprises a yarn texturing unit A which is the area between a first feed roller 11 and an oiling roller 9, and a yarn winding unit B which forms a winding package.

The yarn texturing unit A guides a filament yarn (hereinafter referred to as "yarn") Y such as a synthetic fiber, unwound from a yarn supplying package 6 to the first feed roller 11, and in the process to reach a second feed roller 12 via a heater for texturing (yarn heating device) 3, a cooling plate 4 and a false-twisting device (nip twister) 5, the yarn Y is false-twisted and fixed with heat while being drawn, and bulky process is applied to the yarn Y. Furthermore, the yarn Y is fed through a heater for setting 8 and a third feed roller 13, and a series of texturing process is carried out for applying an oiling process by the oiling roller 9.

Further, a feeler 22 and a cutter 14 are provided between the oiling roller 9 and the third feed roller 13. Moreover, W is a work space for the workers.

The false-twisting device 5 is constructed with a pair of twisting belts 2, 2 provided in the shape of letter X from the side view, perpendicular to one another, as to sandwich the yarn Y, and driving motors 10, 10 for each twisting belts 2, 2. By driving two twisting belts 2, 2 in the direction intersecting to one another at a high speed, the yarn Y to be transported can be twisted at a high speed. Further, the form of the false-twisting device 5 is not to be limited to such nip belt type, and the false-twisting device 5 of other forms, such as a friction disc type, can also be used.

Figure 3:
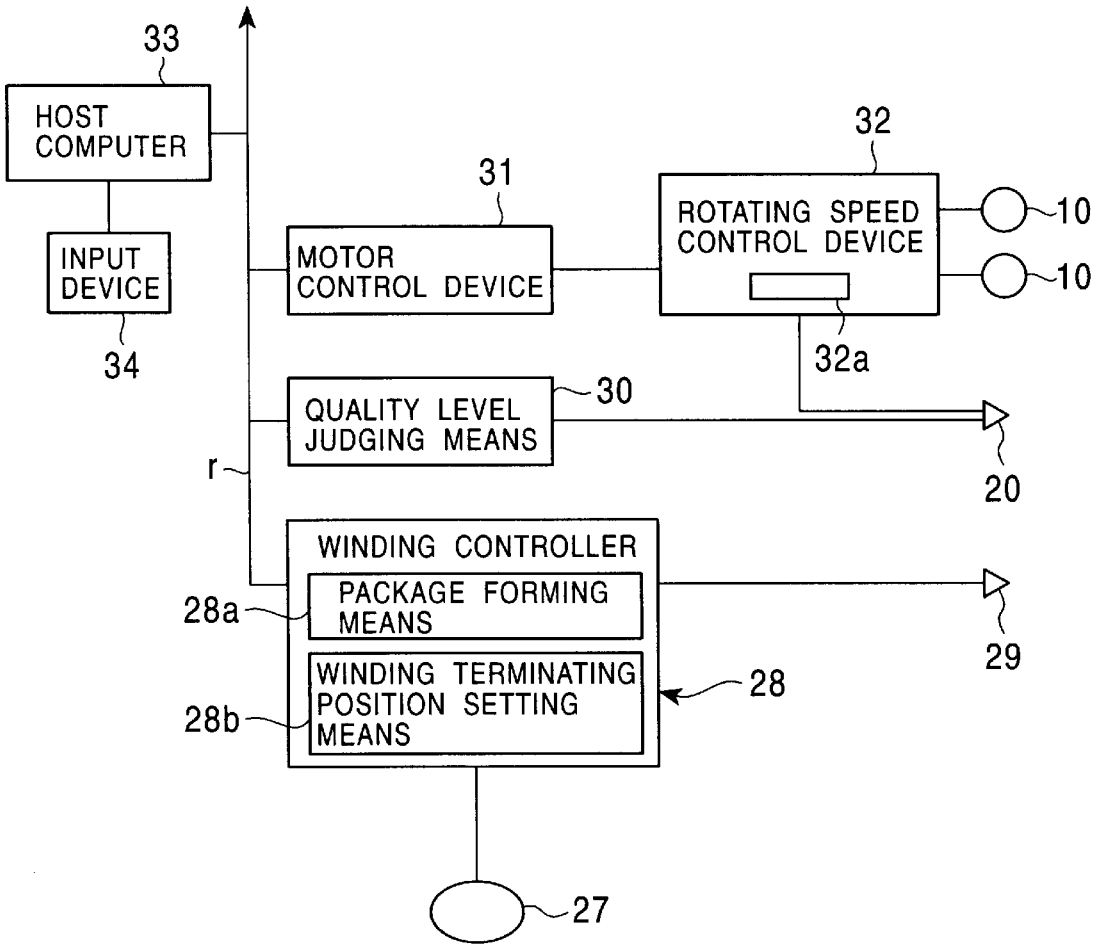
FIG. 3 is a block diagram showing the outline of the control system of the draw texturing machine as a yarn texturing device of the same.

In the downstream side, in other words, in the untwisting side of the false-twisting device 5, a tension sensor 20 for detecting the yarn tension at the untwisting side continuously, is provided. The tension sensor 20 is connected to a rotating speed control device 32 for the driving motors 10, 10 for the twisting belt 2. As shown in FIG. 3, the rotating speed control device 32 includes a circuit 32*a* for carrying out a feed back control to the rotating speed of the driving motors 10, 10 so that the untwisting tension which is the detected tension settles in the target range (between Tu and Td of FIG. 4).

Figure 2:
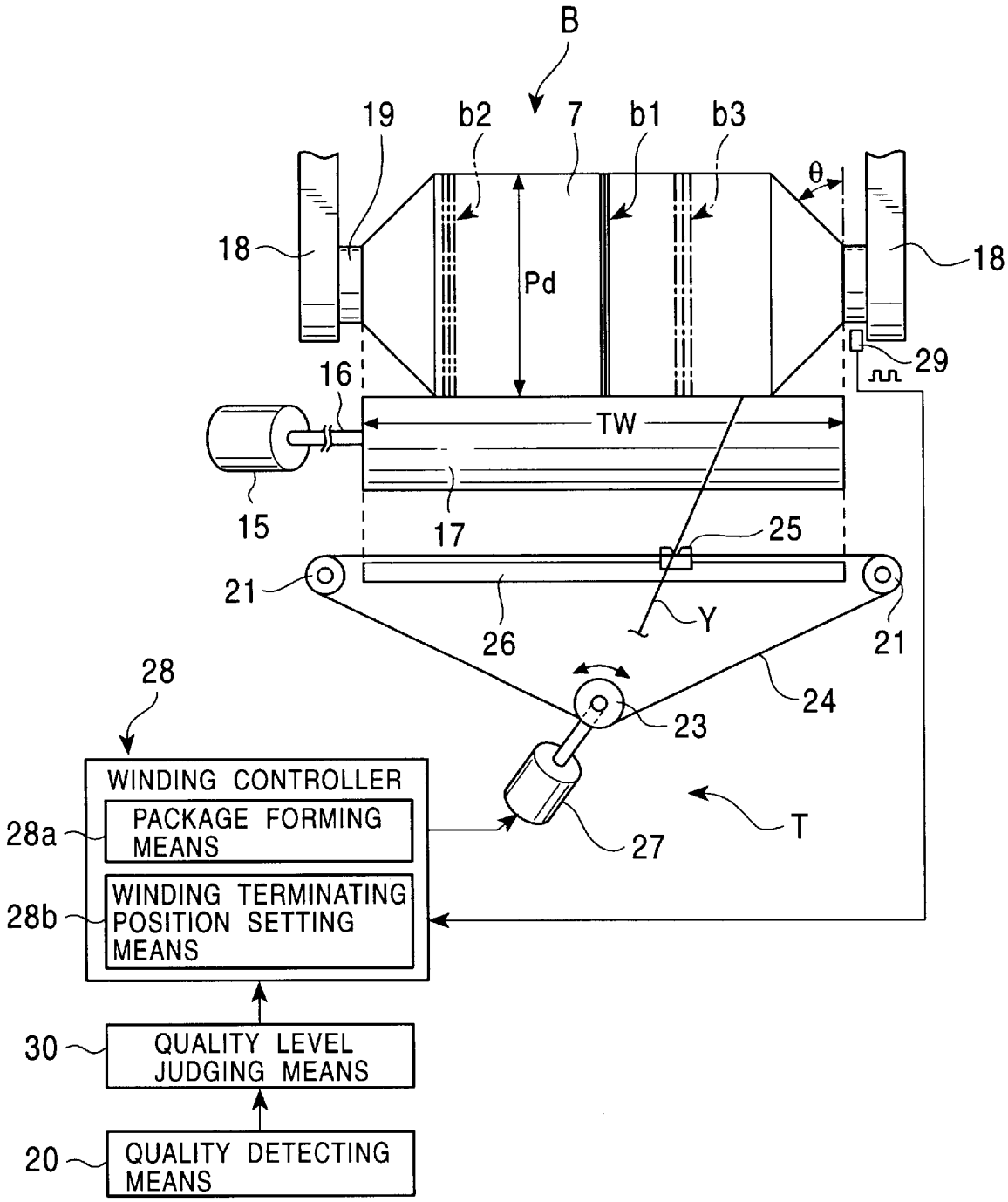
FIG. 2 is a schematic diagram showing the structure of the yarn winding unit of the yarn texturing device of the same.

As shown in FIG. 2, the yarn winding unit B comprises a winding drum 17, a traverse device T, a cradle 18 and a winding controller 28. The winding drum 17 is driven by a line shaft 16 which is common for a plurality of spindles to be rotated and driven under a fixed speed by a motor for driving 15. The cradles 18, 18 are urged elastically in the direction to approach to the winding drum 17 by the elastic mechanism (not shown in the drawings) of such as a winding spring. Moreover, a bobbin 19 or a winding package 7 is constructed to rotate by being pressurized against the winding drum 17 to be driven and rotated. Therefore, the peripheral speed of the outermost diameter of the winding package 7 accompanying the rotation is to be maintained at a fixed level regardless of the increase in the winding diameter. Moreover, the cradles 18, 18 rock to the upper side accompanying the increase in the winding diameter. The degree of the increase in the winding diameter of the winding package 7 is detected by, for example, a rotating speed sensor 29 for detecting the rotating speed per unit time of the winding package 7. In addition, the degree of the increase in the winding diameter of the winding package 7 can be detected from an angle detected by an angle sensor for detecting rocking angles of the cradles 18, 18, and the distance from the cradles 18, 18 to the winding drum 17. Further, in the example illustrated in FIG. 2, the motor for winding 15 is shared by a plurality of spindles, however, a motor for winding for rotating and driving the winding drum 17 or the bobbin 19 can be provided per each spindle.

The traverse device T traverses the yarn (running yarn) Y to be wound on the bobbin 19 in the axis direction of the bobbin 19 by the driving of the driving motor in both directions. Moreover, the traverse device T comprises two driven pulleys 21, 21 arranged in the horizontal direction each other of which extend the entire width of the bobbin 19, one driving pulley 23 provided in the middle of the driven pulleys 21, 21 so as to form a triangle in cooperation with the driven pulleys 21, 21, an endless belt 24 wound in a triangular shape over the driven pulleys 21, 21 and the driving roller 23, a traverse guide 25 fixed onto the endless belt 24, a guide rail 26 for guiding the posture of the traverse guide 25 during transferring, a reversible motor as a traverse motor 27 capable of driving the driving pulley 23 in both directions, and the winding controller 28 of the reversible motor 27. According to such structure, the traverse device T can stop the traverse guide 25 (reversible motor 27) at any position within the traverse range for any period of time, only by the electric control of the winding controller 28. As a result, the straight winding can be formed at a designated position in the axis direction.

The traverse device T forms the winding package 7 by transferring alternately the traverse guide 25 in the axis direction of the bobbin 19 by the endless belt 24 driven by the reversible motor 27. By controlling by a package forming means 28*a* of the winding controller 28, the rotating speed in the forward direction and backward direction and the time required for one alternating motion of the reversible motor 27 according to the winding condition (for prescribing the form of the winding package) input in advance, the number of winding per one alternating motion of the traverse guide 25 and a taper angle θ of the winding package 7 can be determined.

As in the manner stated above, since the peripheral speed of the outermost diameter of the winding package 7 is constant, accompanying the increase in the winding diameter, the rotating speed (rotating number per unit time) of the winding package 7 decreases and the change in the rotating speed is to be detected by the rotating speed sensor 29. By a function of the package forming means 28*a* of the winding controller 28 for controlling the reversible motor 27, the traverse width TW is reduced gradually accompanying the increase in the winding diameter, and to form a taper end package, the taper angle θ and the winding package diameter Pd are set. In other words, the package forming means 28*a* is provided with a function of taper end package forming means.

Since the winding drum 17 is rotated at a fixed speed, the diameter of the winding package 7 can be figured out if the rotating speed of the rotating winding package 7 is available. Therefore, the diameter of the winding package 7 at the time being can be calculated from the detected information of the rotating speed sensor 29. Accordingly, the finishing diameter Pd of the winding package 7 is to be input to the winding controller 28 beforehand via an input device 34 of a host computer 33, a full wound detecting means for detecting a full wound from the input set value and the detected information of the rotating speed sensor 29, is also provided in the package forming means 28*a*.

The traverse device T forms the winding package 7 by transferring alternately the traverse guide 25 in the axis direction of the bobbin 19 by the endless belt 24 to be driven by the reversible motor 27. A winding terminating position setting means 28*b* is provided in the traverse device T for setting to a designated position for a straight winding to be formed on the surface of the winding package 7 at the finishing of the winding process of the winding package 7 by locating the stopping position of the traverse guide 25 by the reversible motor 27 at a designated position of the guide rail 26 at the finishing of winding process (when a full wound is accomplished). In the example illustrated in FIG. 2, a straight winding position can be set at three positions, namely, a straight winding position (b1) of the center of the winding package 7, a straight winding position (b2) of either end of the left or the right of the winding package 7, and a straight winding position (b3) between the center of the winding package 7 and either the left end or the right end of the winding package 7. Further, as shown in the example illustrated in the drawing, when the winding package 7 is a taper end package having a taper surface at both sides of the axis direction, both ends of left and right are the ends in the axis direction at the base surface section (cylindrical section) between the taper surface of both sides.

Next, referring to the block diagram of FIG. 3, the control structure of the draw texturing machine will be described.

According to the present embodiment, as shown in FIG. 1, one draw texturing machine is constructed by the spindles provided in a plurality of lines from the yarn supplying package 6 to the winding package 7. As shown in FIG. 3, each spindle of the draw texturing machine comprises the winding controller 28, a quality level judging means 30, a motor control device 31 and the rotating speed control device 32 respectively. The draw texturing machine comprises the host computer (upper level control device) 33 in the edge of the machine, and the host computer 33 is connected to a plurality of winding controller 28 via a communication line (r) (serial communication line). Moreover, the host computer 33 is connected to a plurality of quality level judging means 30 and a plurality of motor control devices 31 via the communication line (r). As in the manner stated above, the host computer 33 is connected to a plurality of control devices via the communication line (r), however, the connecting form is not to be limited to the example illustrated in the drawings, and it can be changed accordingly.

The winding controller 28 is connected to the traverse motor 27 and controls the reversible motor 27 separately based on the speed pattern set in advance. Moreover, the winding controller 28 is connected to the rotating speed sensor 29, and includes a means for inputting the rotation detected signal of the rotating speed sensor 29 and calculating the present winding diameter from the rotation detected signal. A tension monitor (quality level judging means) 30 is connected to the tension sensors 20 provided in each spindles, and based on the detected tension value of the tension sensor 20, the quality level of the false-twist textured yarn of each spindles is judged separately. The motor control device 31 is connected to the rotating speed control device 32 and transmits the target tension value and/or the target rotating speed value to the rotating speed control device 32. By using the target tension value and/or the target rotating speed value transmitted from the motor control device 31, the rotating speed control device 32 controls the rotating speed of the driving motors 10, 10 which are the motors for driving the false-twisting device. Further, in FIG. 3, an example in which each control devices 28, 30, 31, 32 are provided of separate bodies is shown, however, a part of or all of these control devices can be formed into one body, and each function can be carried out by a common central processing unit (CPU).

Figure 4:
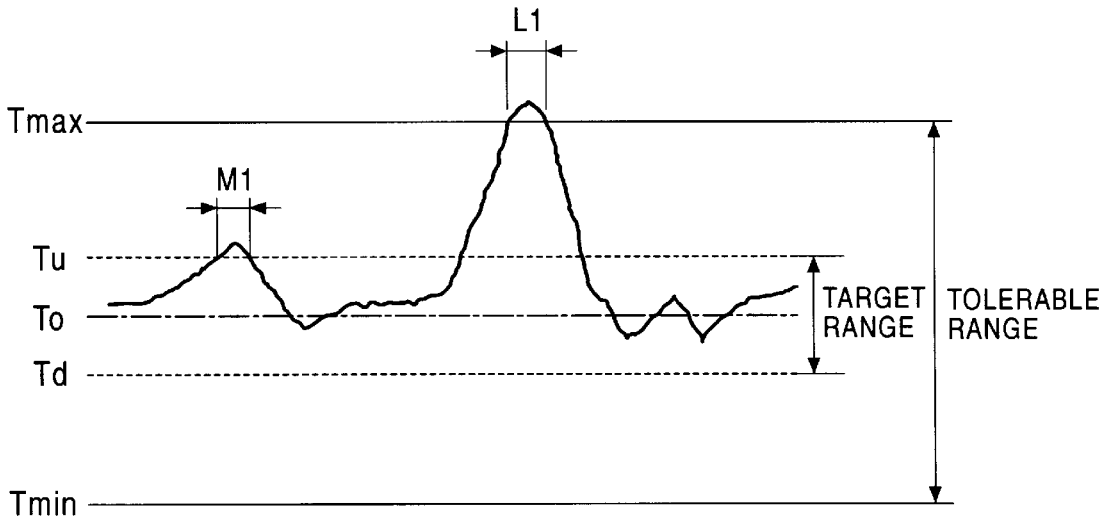
FIG. 4 is a graph showing an example of the quality level judgment of the draw texturing machine as a yarn texturing device of the same.

As in the manner stated above, the tension monitor 30 as the quality level judging means judges the quality level of the winding package 7 based on the detected tension information of the yarn Y by the tension sensor 20 (an example of the quality detecting means) during the winding process (during the texturing process). As shown in FIG. 4, based on the degree included in the yarn Y of the winding package 7 of the accumulation (yarn length) of the detection term M1 wherein the untwisting tension is exceeding the target range (between Tu and Td), or the accumulation (yarn length) of the detection term L1 wherein the untwisting tension is exceeding the tolerable range (between Tmax and Tmin), it is judged into a grade A of the advanced level, a grade B of the intermediate level, and out of the standard. The judged information is transmitted to the winding controller 28 when a full package is achieved, and the winding terminating position setting means 28*b* determines the stopping position of the traverse guide 25 of the traverse device T so that the straight winding position in the axis direction of the bobbin 19 at the finishing of the winding process of the package 7 is determined to be either (b1), (b2) or (b3).

Further, the relationship of the quality level (grade) of the winding package 7 and the straight winding position can be set and input optionally to the winding controller 28, and the winding terminating position setting means 28*b* comprises a storing unit for storing the relationship between the quality level set and input, and the straight winding position. Further, in FIG. 4, To is the target tension value during the feed back control, and Tu and Td, Tmax and Tmin are set respectively to both the high level and the low level with the target tension To as the center.

In other words, when the detected tension value of the tension sensor 20 is within the range of the predetermined value input beforehand in the quality level judging means 30, the yarn quality is of a desired preferred condition. The quality level of the winding package 7 wound by the reasonable tension is to be the advanced level. As in this manner, when it is judged to be the advanced level by the quality level judging means 30, the reversible motor 27 is controlled at the finishing of the winding process, the straight winding is applied in the center position (b1) of the winding package 7, and the winding is completed (the condition shown with a solid line in FIG. 2). In other words, when the position of the straight winding which is the finishing of the winding process of the winding package 7 is located at the center position (b1), the quality level of the winding package 7 can be instantly confirmed that it is of the advanced level, namely, the grade A.

As in the same manner, when the detected tension value of the tension sensor 20 is exceeding the range of the predetermined value, the yarn quality is somewhat not preferable. The quality level of the winding package 7 by such tension is to be intermediate level, and the straight winding is to be formed at the position (b2), either one of the left end or the right end of the winding package 7 (refer to the chained double-dashed line in FIG. 2). Moreover, when the detected tension value of the tension sensor 20 exceeds the range of the predetermined value greatly, the yarn quality is under poor condition, and the quality level of the winding package 7 is to be out of standard. The straight winding is to be formed at the position (b3) between the center and either end of the left or the right of the winding package 7 (refer to the dashed line in FIG. 2).

Therefore, by looking at where the position of the straight winding is located in the winding axis direction of the winding package 7, the quality level of certain winding package 7 can be confirmed. In other words, it can be understood that when the straight winding is located at either end of left or right, the quality level of the yarn is "intermediate level", and when it is located at the center, the quality level is "advanced level", and when it is located between the center and the end, the quality level is "out of standard".

Likewise, there is an advantage in that when the position of the straight winding are set differing to one another according to the three types of levels, even when the left and the right of the winding package 7 of which is symmetrical becomes unclear, it can be confirmed reliably of the advanced level, intermediate level or out of the standard. Since the indication of the quality level by the straight winding position is formed at the finishing of the winding process of the winding package 7, and it is maintained until the winding package 7 is unwound next, it is a reliable indication in that a miss attachment is far from occurring during the process. The workers can confirm the indication with a glance, and the winding packages 7 can be classified during packing. Moreover, by confirming the straight winding position by CCD camera, the quality level can be confirmed at any positions during the transportation of the winding package 7, and it can be corresponded to the automation.

Figure 5:
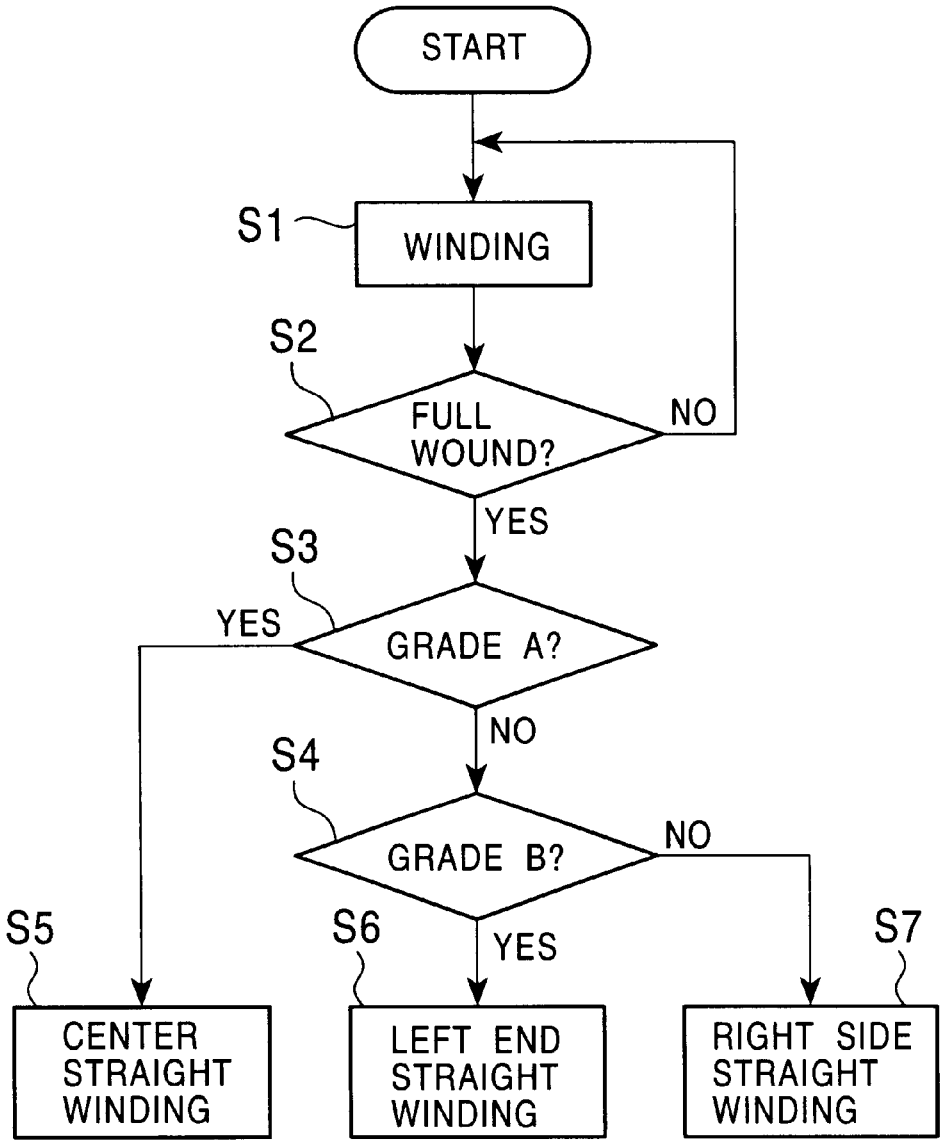
FIG. 5 is a flow chart showing an example of the quality level judging procedure of the draw texturing machine as a yarn texturing device of the same.

As a reference, FIG. 5 shows a control flow chart of the quality level judgment. In FIG. 5, the grade A is aforementioned "advanced level", and in the same manner, the grade B is the "intermediate level", and grades other than the grade A or the grade B are "lout of standard". The flow starts by the start of the winding (step S1). Until a desired full wound is accomplished (step S2, NO), the winding is continued while monitoring the quality. When a desired full wound is accomplished (step S2, YES), the quality level judging means 30 judges the quality level of the winding package 7. When the quality level is the grade A (step S3, YES), a center straight winding (b1 position) is applied by stopping the traverse guide 25 at the center position in the axis direction of the winding package 7 for a designated period of time (step S5). When the quality level is not the grade A (step S3, NO) and the quality level is the grade B (step S4, YES), the traverse guide 25 is stopped for a prescribed period of time at the left end position in the axis direction of the winding package 7, and the straight winding is applied to the left end (b2 position) (step S6). When the quality level is not the grade B (step S4, NO), the traverse guise 25 is stopped for a prescribed period of time at a position between the center position and the right end position in the axis direction of the winding package 7, and a straight winding is applied to the right side (b3 position) (step S7).

Other Embodiment

According to the embodiment of the present invention, the straight winding position of the winding package 7 can be provided at three places, namely, center, left end, and right end. In such case, it is further preferable when there are marks or the like for determining the left and the right of the winding package 7. Moreover, the evaluation level of the quality level can be two levels or more than four levels.

Furthermore, according to aforementioned embodiment, only the detected tension information was used for the judgment of the quality level of the winding package 7, however, in addition to such information, the yarn amount of the winding package 7 can be reflected on the judgment of the quality level. In such case, for example, when a yarn breakage occurs before the full wound is accomplished, it is judged to be the grade B or out of standard.

The traverse device T can be a mechanical structure of public domain of rotating in one fixed direction by the motor drive, the traverse drum wherein a guide channel is formed where the traverse guide is to be engaged. Moreover, the taper end forming means can form a taper end package by narrowing the traverse width TW (alternating motion range) of the traverse guide by the link mechanism or the like of the public domain accompanying the increase in the winding diameter of the winding package 7. In such case, the rotation stopping position of the traverse drum can be controlled so that the stopping position of the traverse guide is to be designated, or a regulating member capable of receding for regulating the yarn to be traversed at the finishing of the winding process to the designated position of the traverse width is provided as a winding terminating position setting means so that the stopping position of the traverse guide is to be designated. Moreover, a rotary blade traverse device can be adopted for the traverse device T. In such case, a regulating member capable of receding for regulating the yarn to be traversed at the finishing of winding process to a designated position of the traverse width can be provided as a winding terminating position setting means.

The yarn texturing device and the yarn texturing method according to the embodiment of the present invention was applied to the draw texturing machine. However, it is not to be limited to such embodiment, it can be applied to a take-up winder with godet roller for winding the filament yarn spinning continuously. In such case, the godet roller heats and draws partially the filament yarn to be spun, and corresponds to a yarn texturing unit. The take-up winder corresponds to the yarn winding unit. By detecting the temperature of the yarn passing through the godet roller by a temperature sensor, the quality level of the yarn to be textured is judged, and the straight winding position at the finishing of winding process of the winding package formed by the take-up winder is changed according to the quality level. The winding package formed by such take-up winder is generally referred to as a cheese, a package with perpendicular end surface not including a taper end. Further, by judging the quality level based on the detected tension of the running yarn, or by judging the quality level based on the detected rotating speed of the bobbin holder holding a winding package (bobbin), the take-up winder can change the straight winding position formed at the finishing of winding process according to the quality level.

For a quality detecting means such as the tension sensor 20 of the yarn Y according to the embodiment of the present invention, various means such as a means for detecting the twisting condition of the degree in the numbers of the twisting, and a means for detecting the weight of the yarn Y per unit length, thickness, the degree of the hairiness, color, etc. are capable of being applied. Moreover, for example, the yarn temperature sensor provided in the downstream side of the first heater 3 can be used as the quality detecting means.

As in the manner stated above, according to the yarn texturing device and the yarn texturing method of the present invention, only by the winding treatment continuing from the winding, the identification of the outer appearance can be applied to the winding package. Since each winding packages possess the outer appearance corresponding to the quality level from the time the winding has completed, the grade of the package can be easily judged constantly thereafter, and the package and the grade data corresponds to one another precisely. As a result, the yarn texturing device of high reliability, and simple stricture can be obtained with no management costs.

According to the yarn texturing device of the present invention, aforementioned effects can be achieved especially in the draw and false-twist texturing machine.

Furthermore, the yarn texturing device of the present invention has an advantage in that by designating the quality level of the winding package based on the untwisting tension which is an especially important factor, the reasonable, most appropriate and precise quality level judgment can be carried out in the draw and false-twist texturing machine.

By carrying out a feed back control so that the tension of the yarn is maintained at the target tension value, the yarn texturing device of the present invention can carry out the feed back control so that the quality level of the winding package relating to the untwisting tension becomes the state as set in advance, and the winding package of desired quality level can be manufactured stably. Even in such case, the quality level can be indicated.

What is claimed is:

1. A yarn texturing device which is a yarn winding device including a yarn heating device and a false-twisting device for applying false-twist texturing to a yarn unwound from a yarn supplying package, and a winding device for forming a winding package by winding a false-twist textured yarn, wherein the winding device includes a traverse device for traversing in the axis direction of a bobbin the false-twist textured yarn, and the traverse device is constructed to form a straight winding at the designated position in the axis direction of the winding package; comprising:

a quality detecting means for detecting the quality of the yarn wound to the winding package;

a quality level judging means for judging the quality level of the winding package based on the detected information of the quality detecting means; and a winding terminating position setting means for changing the straight winding position of the traverse device at the finishing of the winding process based on the judged information of the quality level judging means.

2. A yarn texturing device according to claim 1 wherein the quality detecting means is a tension detector for detecting untwisting tension in downstream side of the false-twisting device.

3. A yarn texturing device according to claim 2 comprising:

a feed back control means for carrying out a feed back control of the driving of the false-twisting device so that the detected tension by the tension detector is to maintain the target value set in advance.

4. A yarn texturing device according to any one of claim 1 through claim 3 wherein the quality level judging means judges the quality level of the winding package in a phase, and the winding terminating position setting means sets the straight winding position based on the quality level in a phase judged by the quality level judging means, to at least three patterns, the center position of the winding axis direction, either end side position of the winding axis direction, and the position between the center position and the either end side position of the winding axis direction.

5. A yarn texturing method for texturing a yarn and forming a winding package by winding a textured yarn, wherein the winding package is wound while the textured yarn is traversed in the axis direction of the winding package, comprising:

judging the quality level of the winding package based on the detected result of the quality of the yarn to be wound to the winding package;

changing the straight winding position in the axis direction at the finishing of the winding process of the winding package based on the judged result; and indicating the quality level of the yarn by the straight winding position of the winding package.

6. A yarn texturing method for applying false-twist texturing to a yarn unwound from a yarn supplying package and forming a winding package by winding a false-twist textured yarn, wherein the winding package is wound while the false-twist textured yarn is traversed in the axis direction of the bobbin, comprising:

judging the quality level of the winding package based on the detected result of the quality of the yarn to be wound to the winding package;

changing the straight winding position in the axis direction at the finishing of the winding process of the winding package according to the judged result; and indicating the quality level of the yarn by the straight winding position of the winding package.

* * * * *